US012144399B2

(12) United States Patent
Scott

(10) Patent No.: US 12,144,399 B2
(45) Date of Patent: Nov. 19, 2024

(54) BASE FOR USE ON A TREADMILL AND METHOD

(71) Applicant: Kristine A. Scott, Spruce Grove (CA)

(72) Inventor: Kristine A. Scott, Spruce Grove (CA)

( * ) Notice: Subject to any disclaimer, the term of this patent is extended or adjusted under 35 U.S.C. 154(b) by 522 days.

(21) Appl. No.: 17/578,439

(22) Filed: Jan. 18, 2022

(65) Prior Publication Data

US 2022/0225724 A1 Jul. 21, 2022

(30) Foreign Application Priority Data

Jan. 19, 2021 (CA) ..... CA 3106023

(51) Int. Cl.

| | |
|---|---|
| ***A43B 5/04*** | (2006.01) |
| ***A63B 22/02*** | (2006.01) |
| ***A63B 24/00*** | (2006.01) |
| ***A63B 69/00*** | (2006.01) |
| ***A63B 71/06*** | (2006.01) |

(52) U.S. Cl.

CPC ..... *A43B 5/0401* (2013.01); *A63B 22/025* (2015.10); *A63B 24/0062* (2013.01); *A63B 69/0093* (2013.01); *A63B 71/0622* (2013.01); *A63B 2024/009* (2013.01); *A63B 2024/0093* (2013.01); *A63B 2071/0638* (2013.01); *A63B 2071/0675* (2013.01)

(58) Field of Classification Search

CPC ..... A63G 13/00; A63G 31/16; A43B 5/0401; A63B 22/025; A63B 24/0062; A63B 69/0093; A63B 71/0622

USPC ..... 472/88–91, 60

See application file for complete search history.

(56) References Cited

U.S. PATENT DOCUMENTS

| | | | |
|---|---|---|---|
| 324,065 | A | 8/1885 | Andrews |
| 413,693 | A | 10/1889 | Walker |
| 3,522,951 | A | 8/1970 | Tyson |
| 3,941,377 | A | 3/1976 | Lie |
| 4,423,864 | A | 1/1984 | Wiik |
| 4,691,453 | A | 9/1987 | Tifre |
| 5,312,258 | A | 5/1994 | Giorgio |
| 5,385,520 | A | 1/1995 | Lepine et al. |

(Continued)

FOREIGN PATENT DOCUMENTS

| | | | |
|---|---|---|---|
| CA | 2966911 | A1 | 11/2017 |
| DE | 102012007180 | A1 | 8/2012 |

(Continued)

*Primary Examiner* — Kien T Nguyen

(74) *Attorney, Agent, or Firm* — Burdick Patents, P.A.; Sean D. Burdick

(57) ABSTRACT

A base and method of using a base on a treadmill in which the base comprises three or more first ball bearing assemblies, each ball bearing assembly comprising a ball and a mounting assembly, the base also comprising one or more lower ball bearing assemblies, each lower ball bearing assembly comprising a lower ball and a lower mounting assembly, wherein each lower ball bearing assembly projects down from a plane defined by three or more of the ball bearing assemblies. A base may be attachable to or integrated into a piece of sports footwear or a board of a board sport. A user standing on footwear or a board with one or more bases may rock in one or more direction on the sports footwear to produce a leaning effect wherein one or more lower ball bearing assemblies and two or more ball bearing assemblies contact the ground.

19 Claims, 13 Drawing Sheets

(56) References Cited

U.S. PATENT DOCUMENTS

| | | | | |
|---|---|---|---|---|
| 5,613,856 | A | 3/1997 | Hoover | |
| 5,878,378 | A | 3/1999 | Brommer et al. | |
| 6,065,762 | A | 5/2000 | Brelvi | |
| 6,899,344 | B1 | 5/2005 | Raynor | |
| 9,849,392 | B1 | 12/2017 | Scott | |
| 2002/0084600 | A1 | 7/2002 | Bouldes | |
| 2007/0287547 | A1 | 12/2007 | Gallagher | |
| 2014/0228187 | A1* | 8/2014 | Moscarello ..... | A63B 22/18 482/142 |

FOREIGN PATENT DOCUMENTS

| | | | |
|---|---|---|---|
| WO | 0130464 | A1 | 5/2001 |
| WO | 2009112817 | A2 | 9/2009 |

* cited by examiner

BASE FOR USE ON A TREADMILL AND METHOD

TECHNICAL FIELD

The present invention relates to a rolling base for use on a treadmill, and in particular for virtual sports systems.

BACKGROUND

There exist systems and devices directed towards replicating sports activities for training and exercise purposes. These systems exist in various forms. Various exercise machines are designed to replicate their corresponding activities to various degrees. For example, stationary bikes may be used to replicate outdoor cycling activities. A stationary bike may be equipped or paired with a visual display of a cycling route. The visual display may be affected by the actions of the user, such as progressing at a speed determined by the speed of the user as calculated by the device.

Other examples of these systems include devices like the Wii Fit®, where a visual display and one or more controllers permit a user to replicate a sporting activity and interactively engage with a visual representation of the activity on the visual display.

Canadian Patent Application No. 2,966,911 published on Nov. 13, 2017 discloses footwear and boards with rollers for sporting and gaming purposes which are intended for use on a moving treadmill.

SUMMARY

There is provided a base for use on a treadmill, the base comprising three or more first ball bearing assemblies, each of the three or more first ball bearing assemblies comprising a ball and a mounting assembly and one or more lower ball bearing assemblies, each of the one or more lower ball bearing assemblies comprising a ball and a mounting assembly, wherein each of the one or more lower ball bearing assemblies extends downwards from a plane defined by a subset of three of the three or more first ball bearing assemblies, and an intersection of a vertical projection of the one or more lower ball bearing assemblies onto the plane lies within the convex hull of the subset of three of the three or more first ball bearing assemblies, thereby allowing the base to pivot in multiple directions around the one or more lower ball bearing assemblies when placed on a flat surface.

In various embodiments, there may be provided one or more of: the base being a sole and the sole being integrally formed with a piece of sports footwear; the base being removeably attachable to a piece of sports footwear; the base being a lower surface of a board; the board being a snowboard; the base being used in combination with a snowboarding boot; the three or more first ball bearing assemblies being arranged as two rows of ball bearing assemblies and the at least one or more lower ball bearing assemblies lying between the two rows of ball bearing assemblies; the three or more first ball bearing assemblies being arranged as at least three consecutive rows of ball bearing assemblies on the base or sole and the one or more lower ball bearing assemblies being positioned between each consecutive pair of rows of ball bearing assemblies; the base being used in combination with a treadmill control, the treadmill control being mountable and electrically connectable to the treadmill to control at least one of speed, elevation, and surface variations of the treadmill; each of the one or more lower ball bearing assemblies being larger than three or more first ball bearing assemblies; each of the one or more lower ball bearing assemblies being situated downwardly relatively to the subset of three of the three or more of the first ball bearing assemblies; each mounting assembly of the three or more first ball bearing assemblies and of the one or more lower ball bearing assemblies comprising a mounting socket and a spring.

There is provided a method of using a rolling base on a treadmill, comprising a user standing on a rolling base on an operating treadmill and providing a graphical simulation of a sports activity through a display, wherein the rolling base comprises three or more first ball bearing assemblies, each of the three or more first ball bearing assembly comprising a ball, and a mounting assembly, and the rolling base further comprises one or more lower ball bearing assemblies, each of the one or more lower ball bearing assemblies comprising a ball and a mounting assembly, each one of the one or more lower ball bearing assemblies projecting down from a plane defined by three or more of the ball bearing assemblies.

In various embodiments, the method may further comprise one or more of: controlling operation of the treadmill according to the events occurring in the simulation of a sports activity; wherein controlling operation of the treadmill comprises one or more of controlling the speed, altitude, tilt and surface features of the treadmill; detecting a part of a user and processing the location of a part of the user as a control input for the simulation of a sports activity; wherein detecting a part of a user comprises detecting the location or orientation of a piece of sports footwear worn by the user; wherein detecting a part of a user comprises detecting the location or orientation of one or more of the user's limbs, trunk, and head.

In a further embodiment there is provided a base or sole for a piece of footwear for use on a treadmill, the base or sole comprising four ball bearing assemblies arranged in a rectangular distribution on the base or sole, each of the four ball bearing assemblies comprising a ball and a mounting assembly; and one or more lower ball bearing assemblies arranged within the rectangular distribution, each of the one or more lower ball bearing assemblies projecting downwards from the rectangular distribution of ball bearing assemblies and comprising a ball and a mounting assembly.

These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

In this description various directional terms are employed, including directional terms adopted from anatomical terminology. Longitudinal is taken to mean 'in the lengthwise direction', which, in the context of the foot, refers to the direction from heel to toe. Width is taken to refer to the direction that is perpendicular to the lengthwise direction and that is not vertical. Vertical is used in its common sense and, when used in reference to parts of a shoe or foot herein assumes that the shoe or foot is resting flat and upright on the ground. The word 'lateral' is used in its anatomical sense, meaning away from the midline of the body in the width direction. The word 'medial' is also used in its anatomical sense, meaning towards the midline of the body in the width direction. In the context of the foot and footwear, the lateral direction on a left foot or left shoe is towards the left and the medial direction on a left foot or left shoe is towards the right. Conversely, the lateral direction on a right foot or right shoe is towards the right and the medial direction on a right foot or right shoe is towards the left. A sports boot may be any boot such as those used in alpine sports, such as downhill skiing or snowboarding or other comparable activities, such as water sports like water skiing, wake boarding and surfing.

Figure 5:
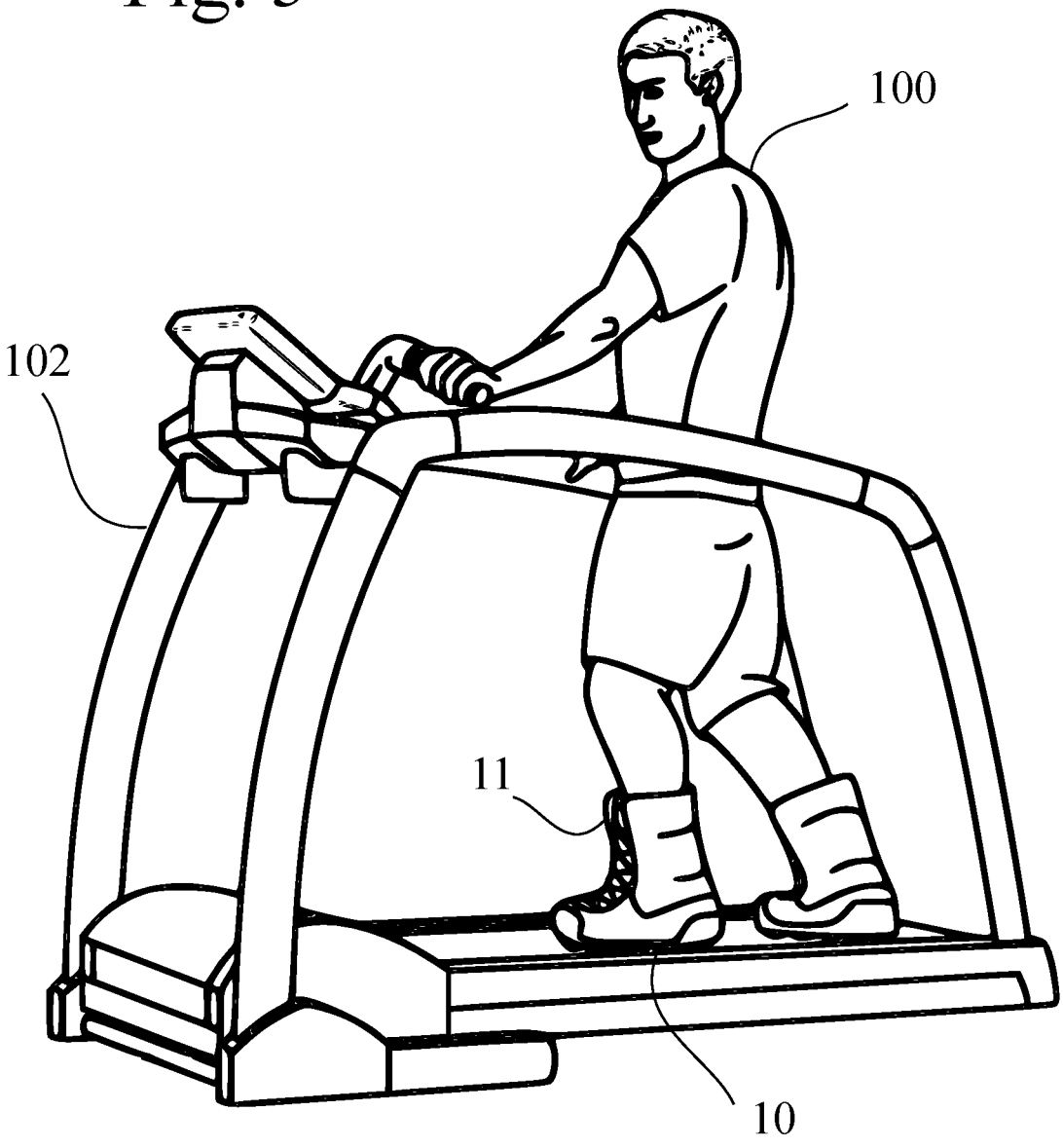
FIG. 5 is a perspective view of a user on a treadmill wearing sports footwear with an attached or integral base or sole according to an embodiment.
Figure 6:
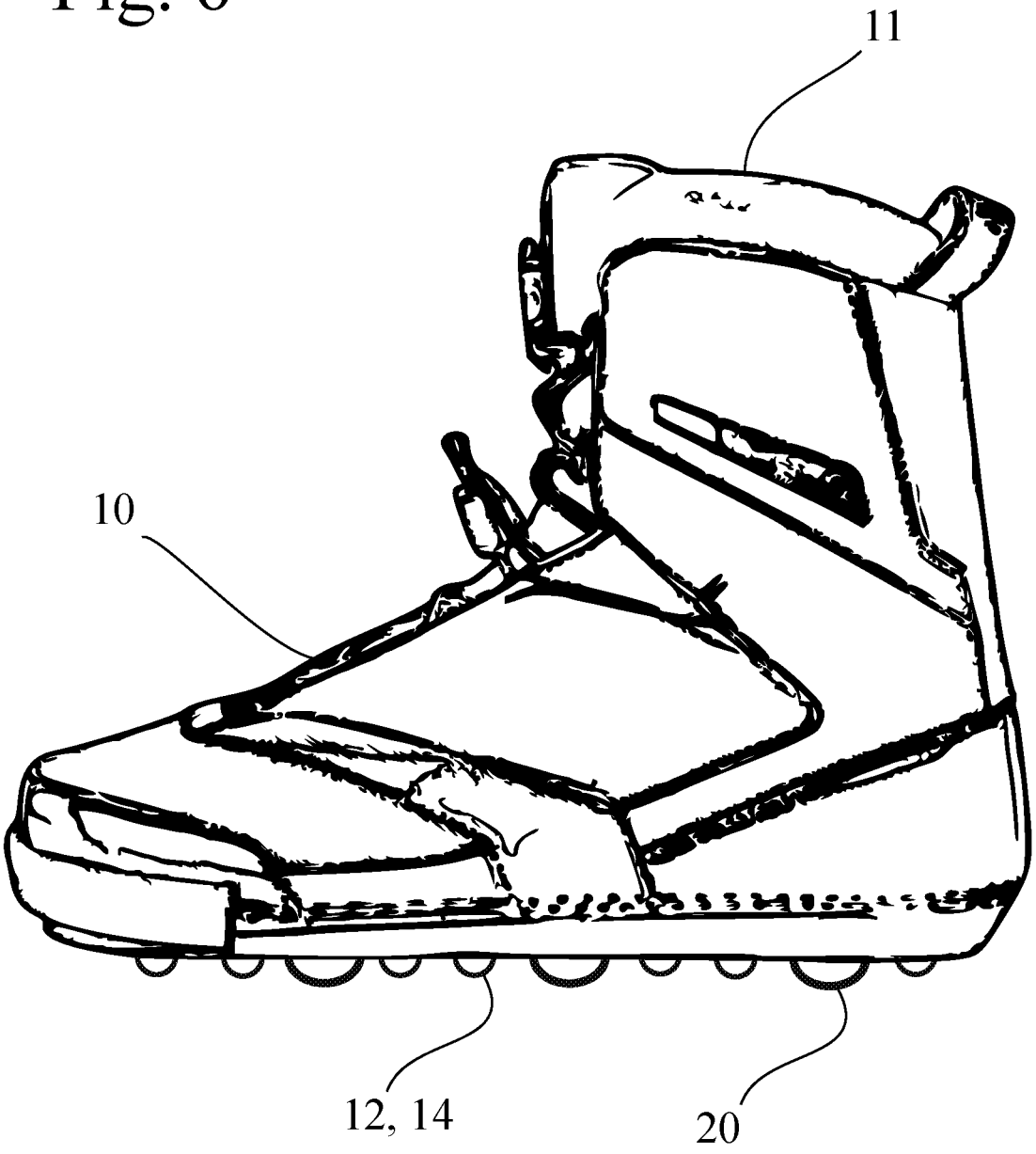
FIG. 6 is a side view of a piece of sports footwear with an integral base or sole according to an embodiment.
Figure 7:
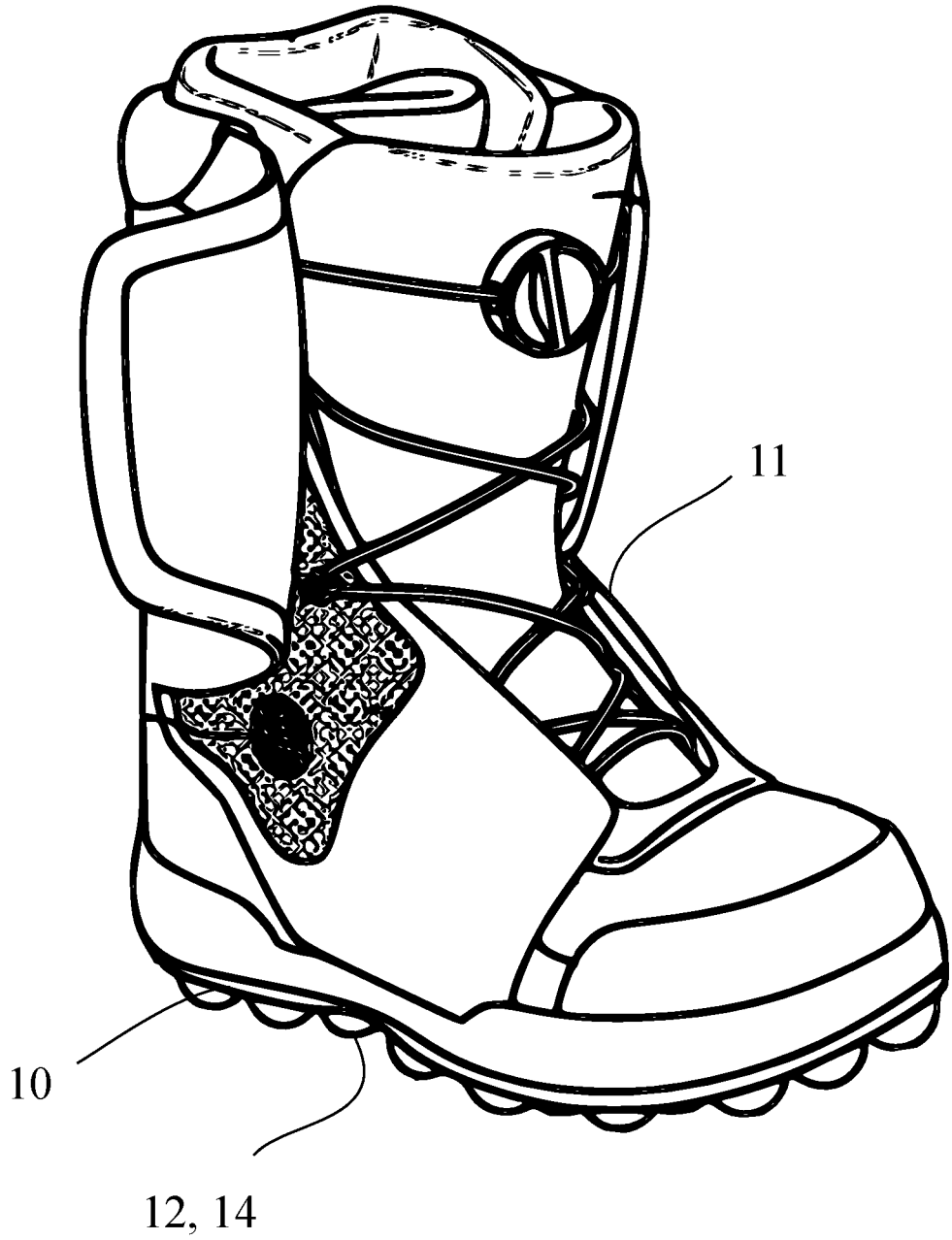
FIG. 7 is a perspective view of a piece of sports footwear with an integral base or sole according to an embodiment.
Figure 8:
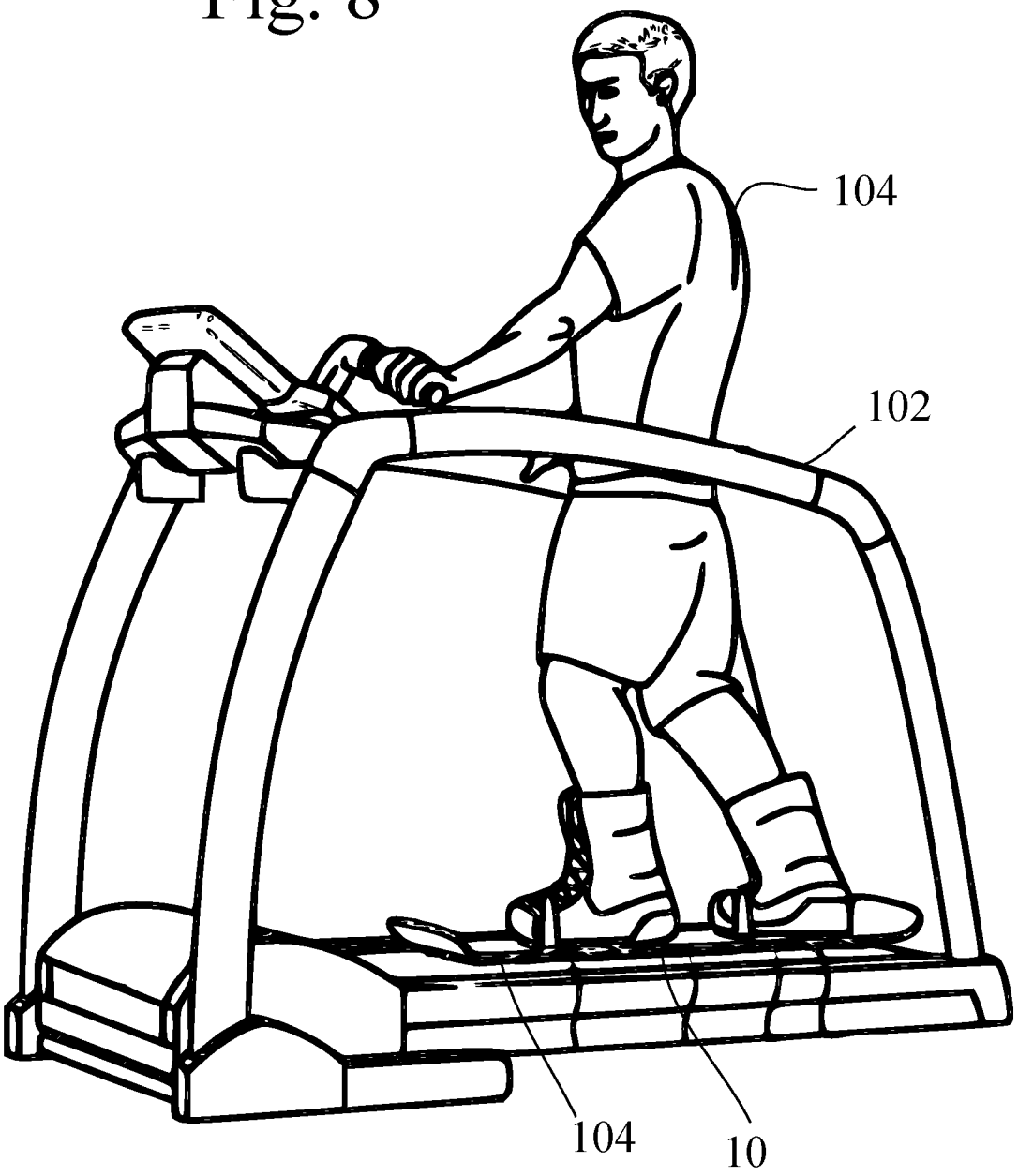
FIG. 8 is a perspective view of a user on a treadmill wearing sports footwear affixed to a board according to an embodiment.
Figure 9:
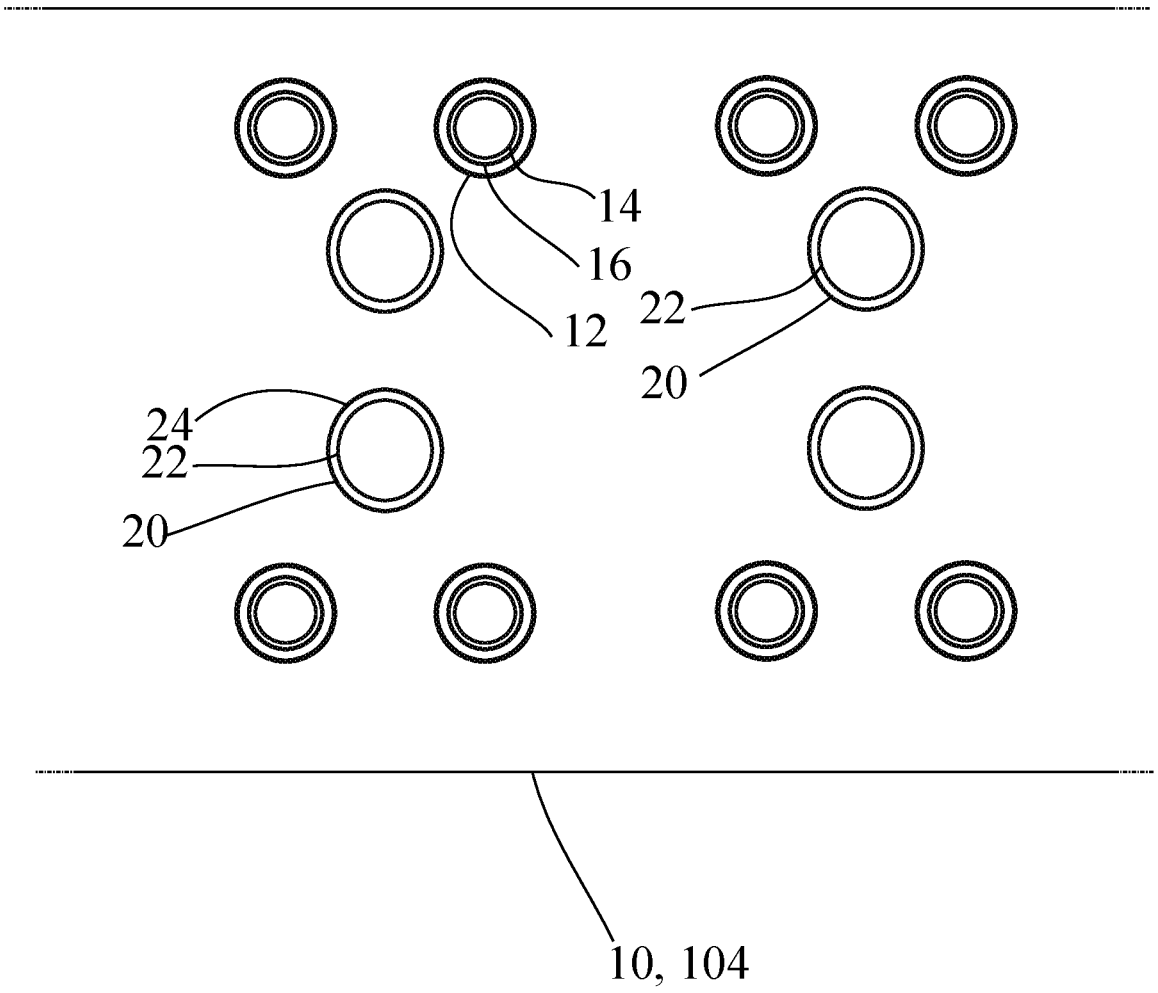
FIG. 9 is a bottom view of a board attached to a piece of sports footwear according to an embodiment.

In the embodiments of FIGS. 1-9, 12 and 13, there are provided various embodiments of a base 10. The base 10 may be a sole of a piece of sports footwear 11 as shown in FIG. 7. The base 10 may be attachable to sports footwear 11 as shown in FIGS. 1-4 and 13 or may be integrally formed with sports footwear 11 as shown in FIGS. 5-7, and 12. The base 10 may be attachable to or integrated into a lower surface of a sports board such as a snowboard or surfboard as shown in FIGS. 8 and 9.

Figure 10:
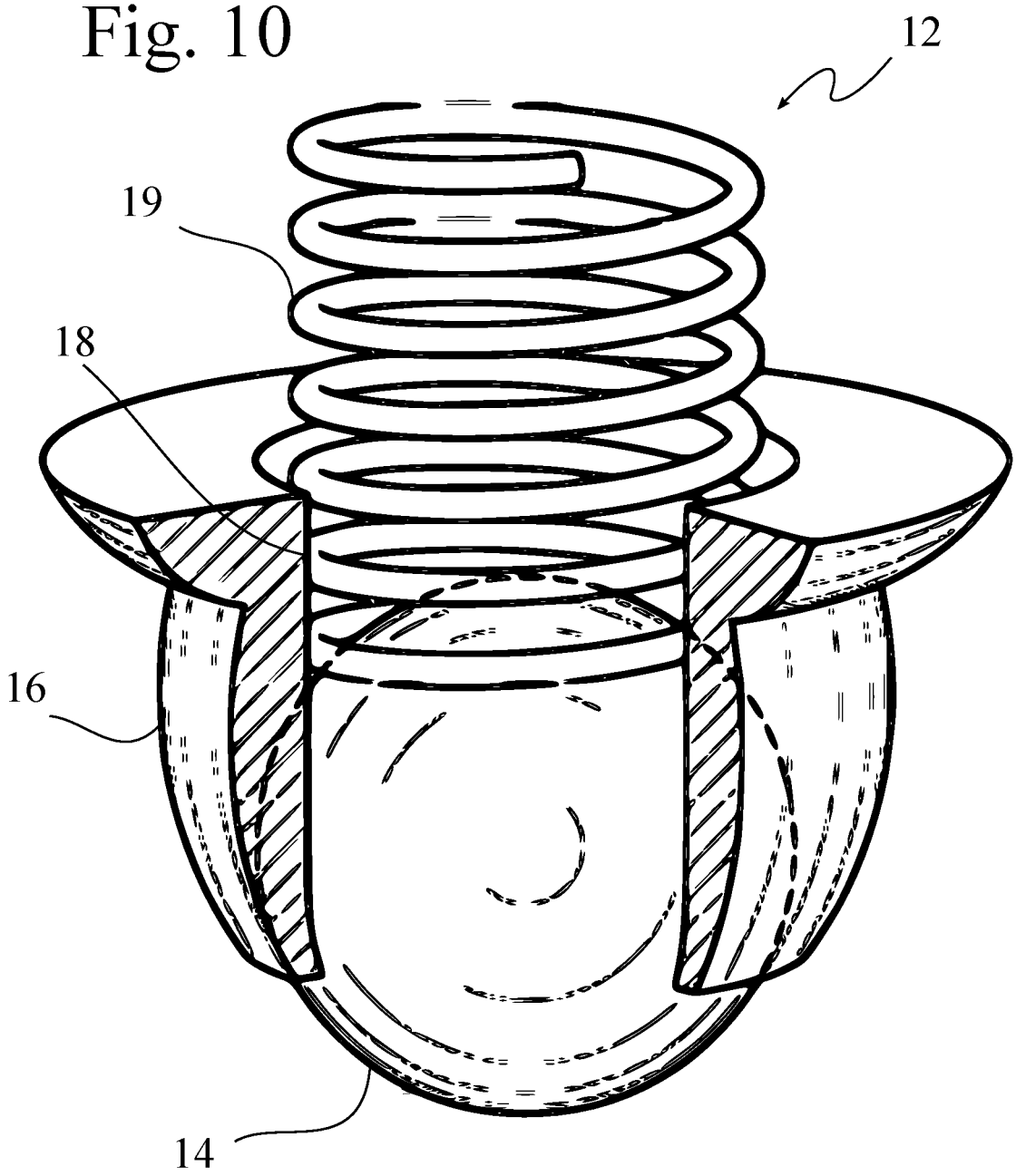
FIG. 10 is a partial cross-section of a ball bearing assembly according to an embodiment.

In the embodiments in FIGS. 1-4, the base 10 comprises three or more ball bearing assemblies 12, each ball bearing assembly 12 comprising a ball 14 and a mounting assembly 16. Each mounting assembly 16 comprises a mounting socket 18 for receiving the ball 14, and a spring 19 within the mounting socket 18 providing an opposing force to the compressive force between the ball 14 and the base 10. FIG. 10 illustrates an exemplary ball bearing assembly 12. The three or more ball bearing assemblies 12 may rest in a single plane. In some embodiments three or more ball bearings assemblies 12 may define two or more lines of ball bearing assemblies 12, in which each line of ball bearing assemblies may or may not rest in a shared plane, as illustrated in FIGS. 1-4.

Figure 11:
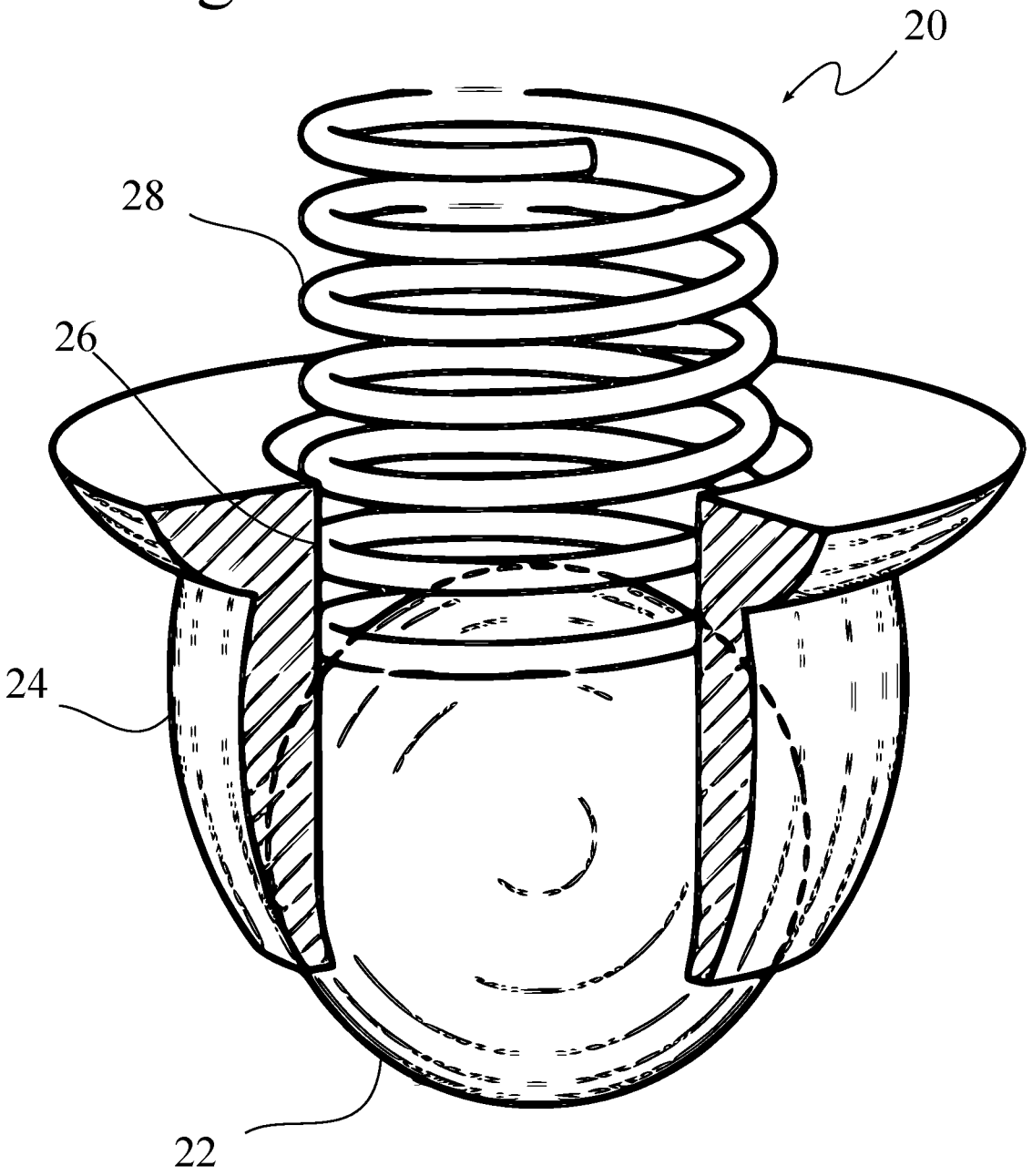
FIG. 11 is a partial cross-section of a ball bearing assembly according to an embodiment.
Figure 12:
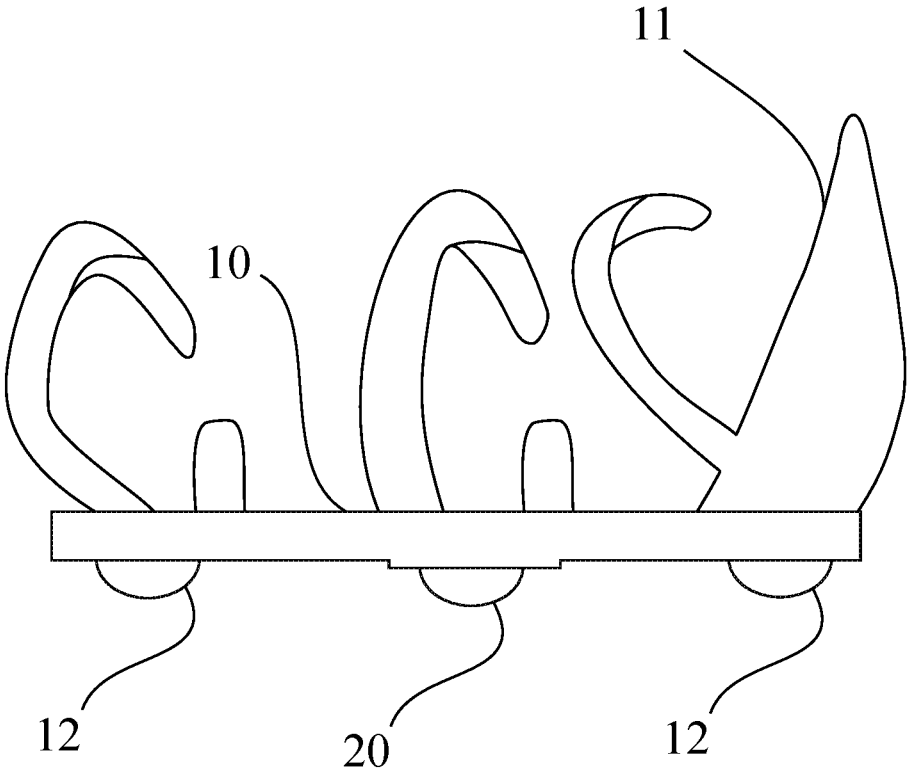
FIG. 12 is a side view of a piece of sports footwear with an integral sole according to an embodiment.

The base also comprises a lower ball bearing assembly 20, the lower ball bearing assembly 20 comprising a ball 22 and a ball bearing mounting assembly 24. The ball bearing mounting assembly 24 comprises a mounting socket 26 for receiving the ball 22, and a spring 28 providing an opposing force to the compressive force between the ball 22 and the base. FIG. 11 illustrates an exemplary lower ball bearing assembly 20. The lower ball bearing assembly 20 may provide a ball 22 that projects further out of the base than the balls of the ball bearing assemblies. The greater projection may, alternatively or in addition, be provided by the ball 22 having a larger radius than the balls 14 of the ball bearing assemblies 12. In some embodiments, the greater projection may be provided by the lower ball bearing mounting assemblies 24 projecting from a common plane of a subset of three or more of the ball bearing assemblies 12, as illustrated in FIG. 12.

In some embodiments, the ball 22 of the lower ball bearing assembly 20 may project further out of the base than the balls of the ball bearing assemblies only when the base 10 is in use and bearing weight, for example, by having springs with different compression-resisting forces in the lower ball bearing assembly than the other ball bearing assemblies. In some embodiments, the ball and mounting assembly of the ball bearing assemblies may be recessed more deeply into the base than those of the lower ball bearing assembly. In some embodiments, the base may have curvature or angular structure such that only a ball 22 of the lower ball bearing assembly 20 and a subgroup of the balls 14 of the ball bearing assemblies 12 contact level ground at the same time, as illustrated in FIG. 7. This may occur, for example, where a lower ball bearing assembly is positioned at the apex of a base with convex curvature and three or more ball bearing assemblies are distributed approximately equidistantly around the lower ball bearing assembly.

The lower ball bearing assembly may be located at a point in the base that is centralized in one or more of the longitudinal and width dimensions of the footwear. In general, the lower ball bearing assembly may be positioned at a point inwardly displaced from an edge of the base. In some embodiments, there may be two or more lower ball bearing assemblies, each lower ball bearing assembly 20 projecting out from the base relative to the ball bearing assemblies 12.

FIG. 6 illustrates a plurality of lower ball bearing assemblies 20 projecting downwards relative to a plurality of ball bearing assemblies 12. The projection of the one or more lower ball bearing assemblies may provide a multiplicity of contact positions in which at least one ball 22 is in contact with the ground and at least two balls 14 are in contact with the ground for each of the pieces of sports footwear 11 to produce a base on which the user's weight may rest. With at least one lower ball bearing assembly 20 and three or more ball bearing assemblies 12 there may be two or more possible contact arrangements. Each contact arrangement involves the sports footwear 11 being oriented at a different angle relative to the ground due to the projection of the lower ball bearing assembly 20. This may allow the user to rock in one or more direction on the sports footwear to produce a leaning effect, replicating the rocking and leaning that the user might experience using a snowboard or skis in alpine sports and comparable activities, such as water sports like water skiing, wake boarding and surfing. For water sports like water skiing, wake boarding and surfing, sports footwear may be provided as sandals or other lightweight footwear providing a base. In some embodiments, a surfboard may be provided as a base with integrated ball bearing assemblies and lower ball bearing assemblies without accompanying straps or footwear structure. In such embodiments, the board with integrated base may be used barefoot or in footwear without attachments to the board. Exemplary arrangements of boards 104 with integrated bases 10 are illustrated in FIGS. 8 and 9.

In some embodiments, two or more lower ball bearing assemblies may be positioned approximately along a central longitudinal axis of each base. This configuration may provide two or more contact positions. In a first one of these contact positions, the ball bearing assemblies situated laterally from the central longitudinal axis contact the surface and one or more ball bearing assemblies situated medially from the central longitudinal axis are raised from the ground. In a second one of these contact positions, the ball bearing assemblies situated medially from the central longitudinal axis contact the surface and one or more ball bearing assemblies situated laterally from the central longitudinal axis are raised form the ground.

In general, embodiments of the base 10 may comprise three or more ball bearing assemblies 12 distributed around the base 10. The base 10, and ball bearing assemblies 12 may rest in a common plane, though this is not necessary. For example, the base 10 may have a surface conforming to a shallow inverted dome, wedge or pyramid. The ball bearing assemblies 12 are distributed so that the convex hull of a subset of three of the ball bearing assemblies 12 has at least a two-dimensional area or a three-dimensional volume. One or more lower ball bearing assemblies 20 may be each either (i) positioned within the convex hull of the distribution of the balls 14 and extending downwards or projecting outwards such that a contact surface of a ball 22 extends outside of the convex hull formed by a plurality of the ball bearing assemblies 12, or (ii) positioned so that a vertical path from the center of the ball 22 intersects the convex hull defined by the subset of three of the ball bearing assemblies 12.

When the base 10 is in use with the sports footwear 11 (either by being integrated with or attached to the footwear), it provides a piece of sports footwear that may be used to simulate various sports activities, including skiing, snowboarding, roller blading, skateboarding, and roller skiing. When used to simulate board sports, the base 10 of each of the left and right pieces of footwear may be connected with a rigid structure to form the lower surface of the board. For example, a base 10 may be integrated into a single rigid board 104 to simulate snowboarding as illustrated in FIGS. 8 and 9. In such an example the base 10 and board 104 may be integrated with or attachable to snowboard boots. The base 10 and board 104 may be removeably attachable to one or more pieces of sports footwear 11.

A plurality of ball bearing assemblies may be arranged as two rows of ball bearing assemblies 12 and at least one lower ball bearing assembly 20 between the two rows of ball bearing assemblies 12. In one particular embodiment, illustrated in 12, a base 10 may be provided as the base of a piece of footwear, the base 10 having four ball bearing assemblies 12 arranged in a rectangular or square distribution on the base, each of the four ball bearing assemblies comprising a ball 14 and a mounting assembly 16. In this particular embodiment, one lower ball bearing assembly 20 is arranged within the rectangular distribution, the lower ball bearing assembly projecting downwards relative to the ball bearing assemblies and comprising a ball 22 and a mounting assembly 24.

Figure 4:
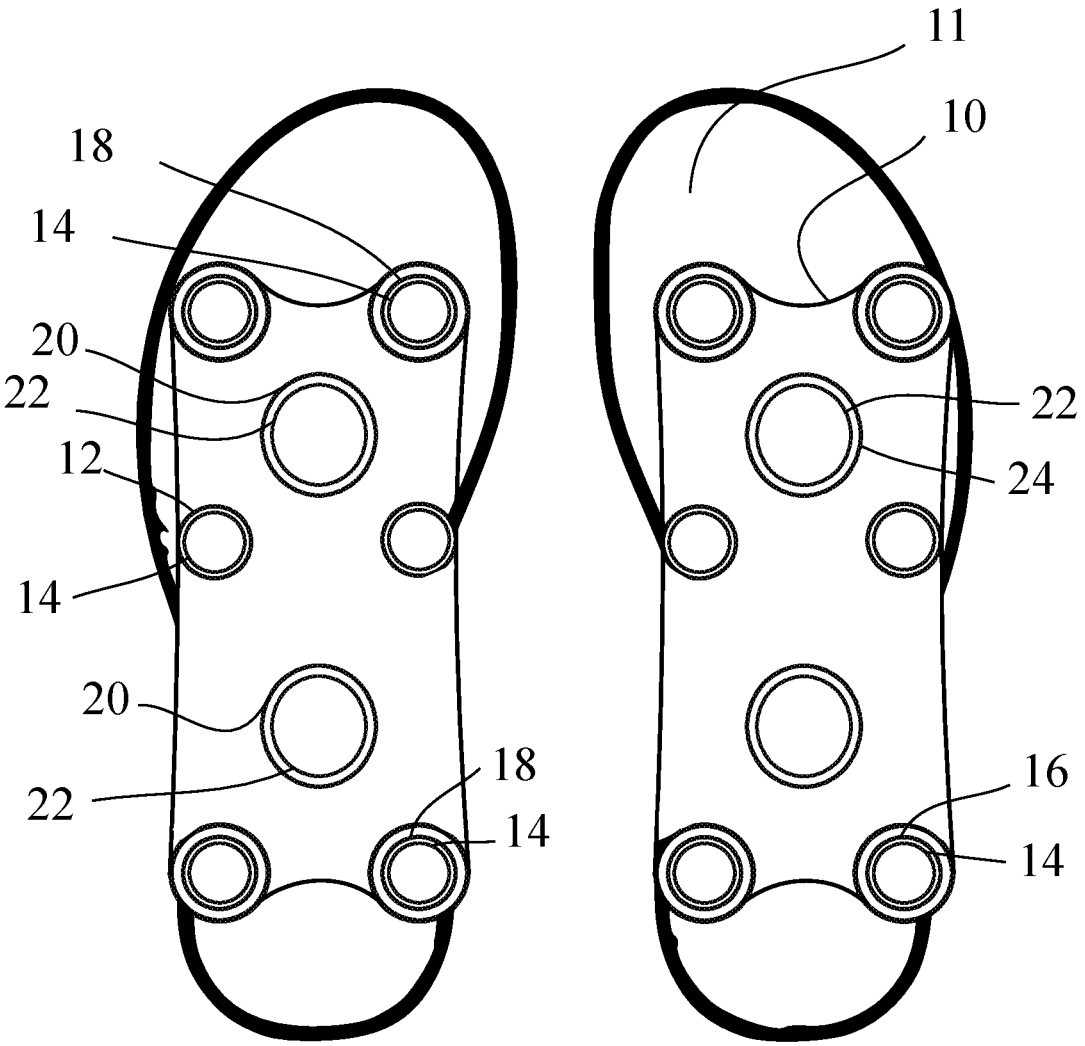
FIG. 4 is a bottom view of a base or sole attached to or integral with a piece of sports footwear according to an embodiment comprising six ball bearing assemblies and two lower ball bearing assemblies.

In some embodiments a plurality of ball bearing assemblies may be arranged as at least three rows of ball bearing assemblies 12 on the base 10, with one or more lower ball bearing assemblies 20 between each row of ball bearing assemblies 12, as illustrated in FIG. 4.

Figure 1:
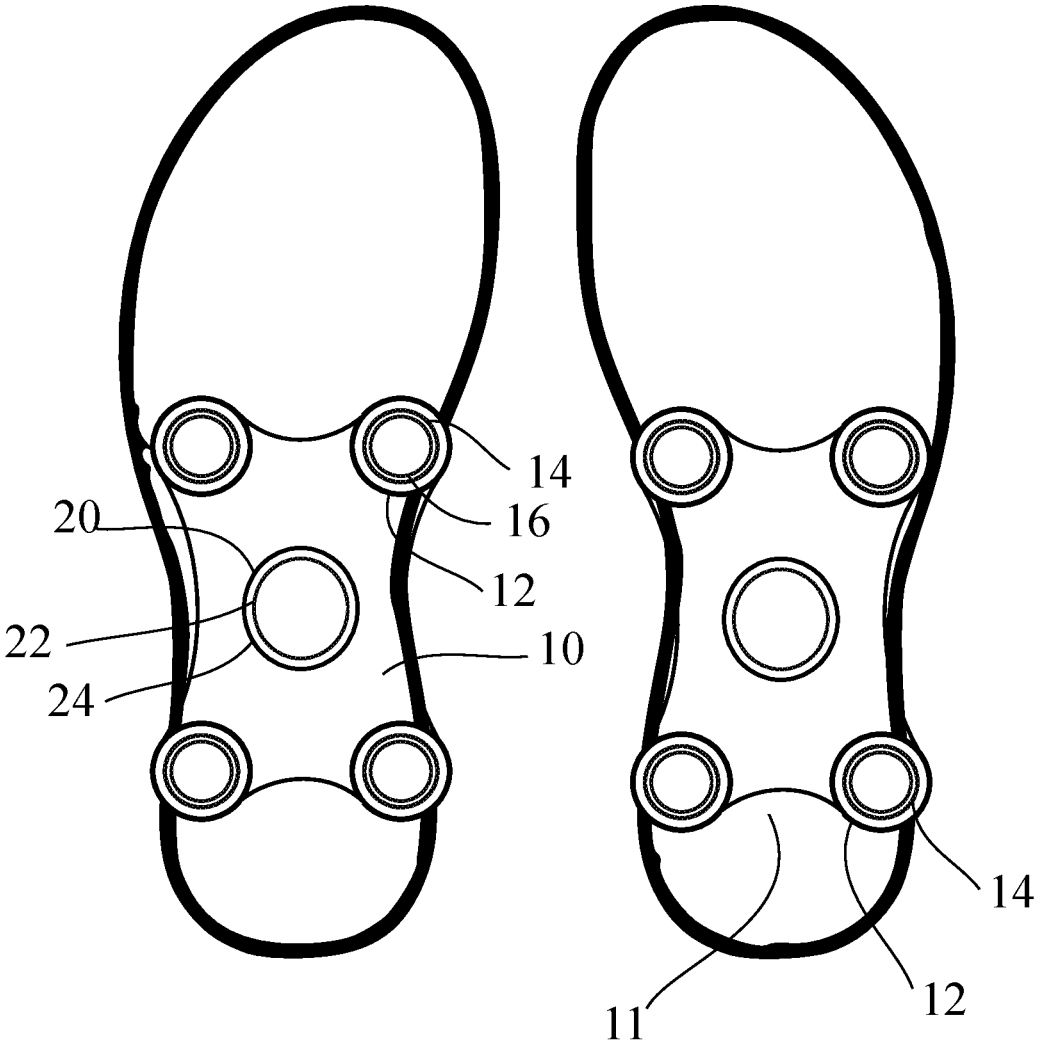
FIG. 1 is a bottom view of a base or sole attached to or integral with a piece of sports footwear according to an embodiment comprising four ball bearing assemblies and one lower ball bearing assembly.
Figure 2:
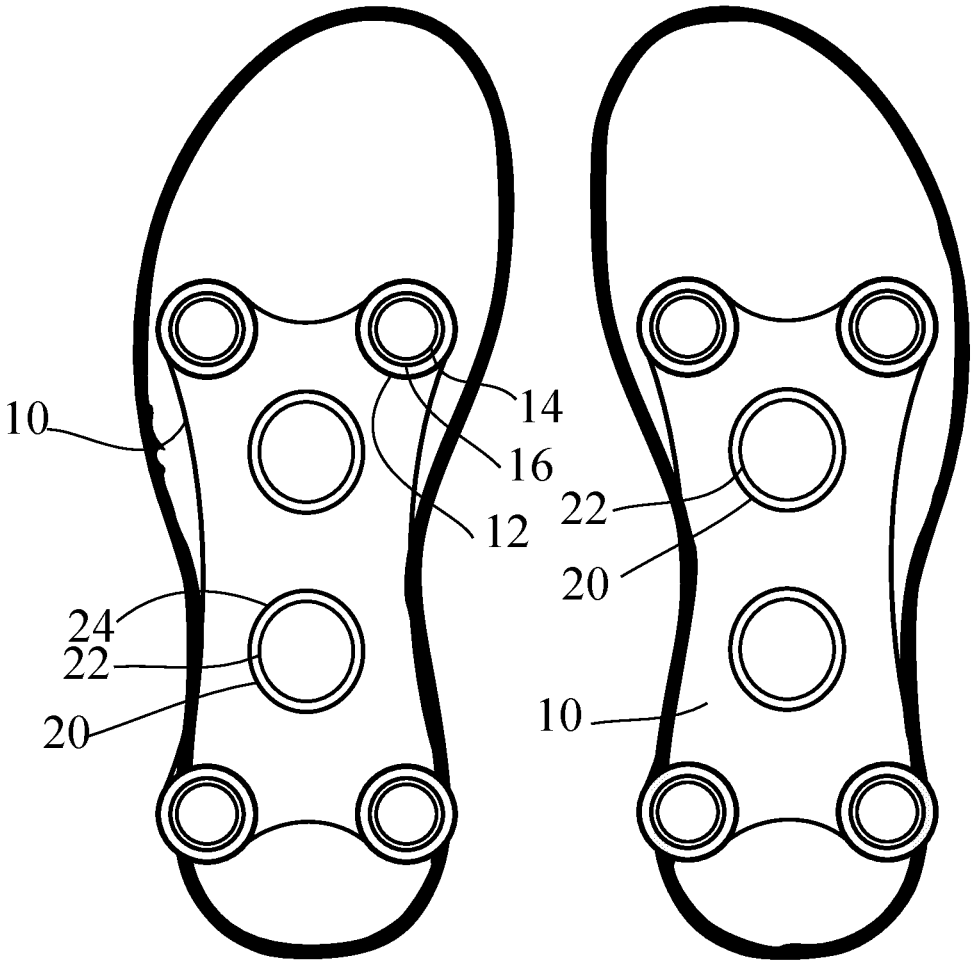
FIG. 2 is a bottom view of a base or sole attached to or integral with a piece of sports footwear according to an embodiment comprising four ball bearing assemblies and two lower ball bearing assemblies.
Figure 3:
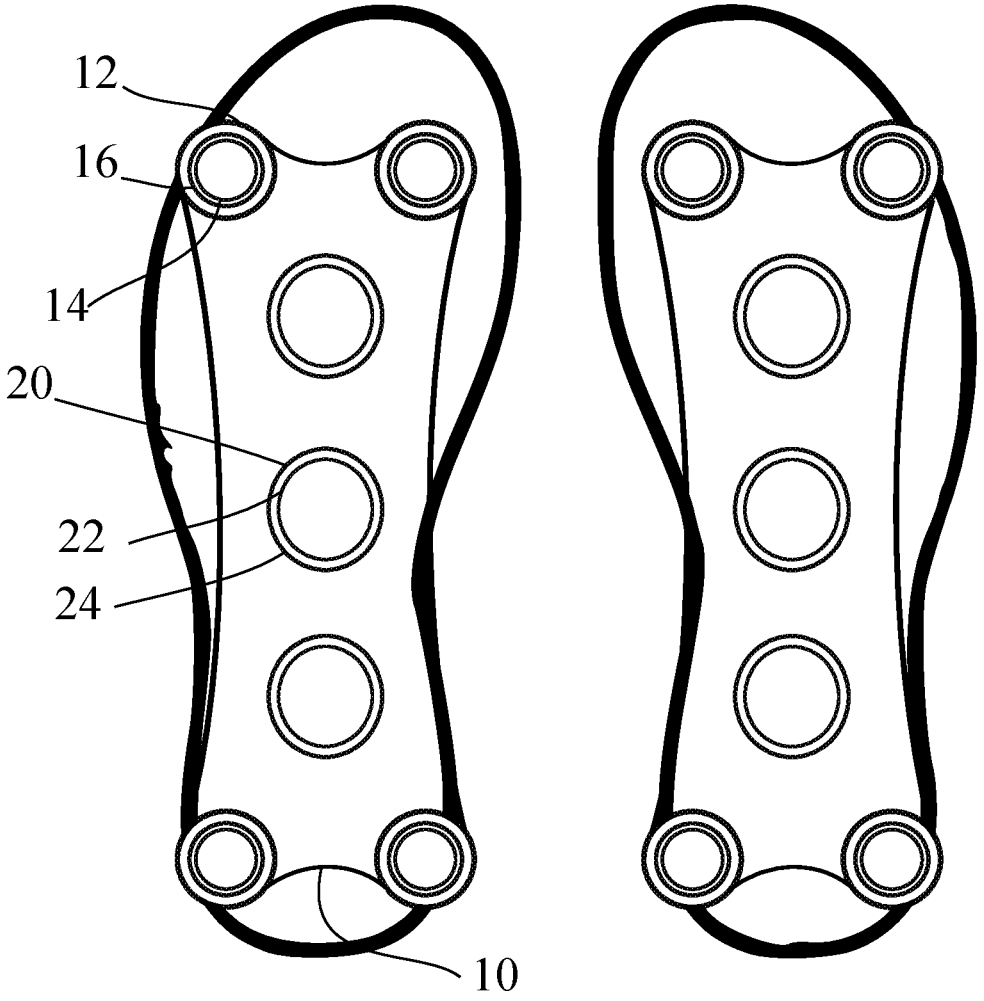
FIG. 3 is a bottom view of a base or sole attached to or integral with a piece of sports footwear according to an embodiment comprising four ball bearing assemblies and three lower ball bearing assemblies.
Figure 13:
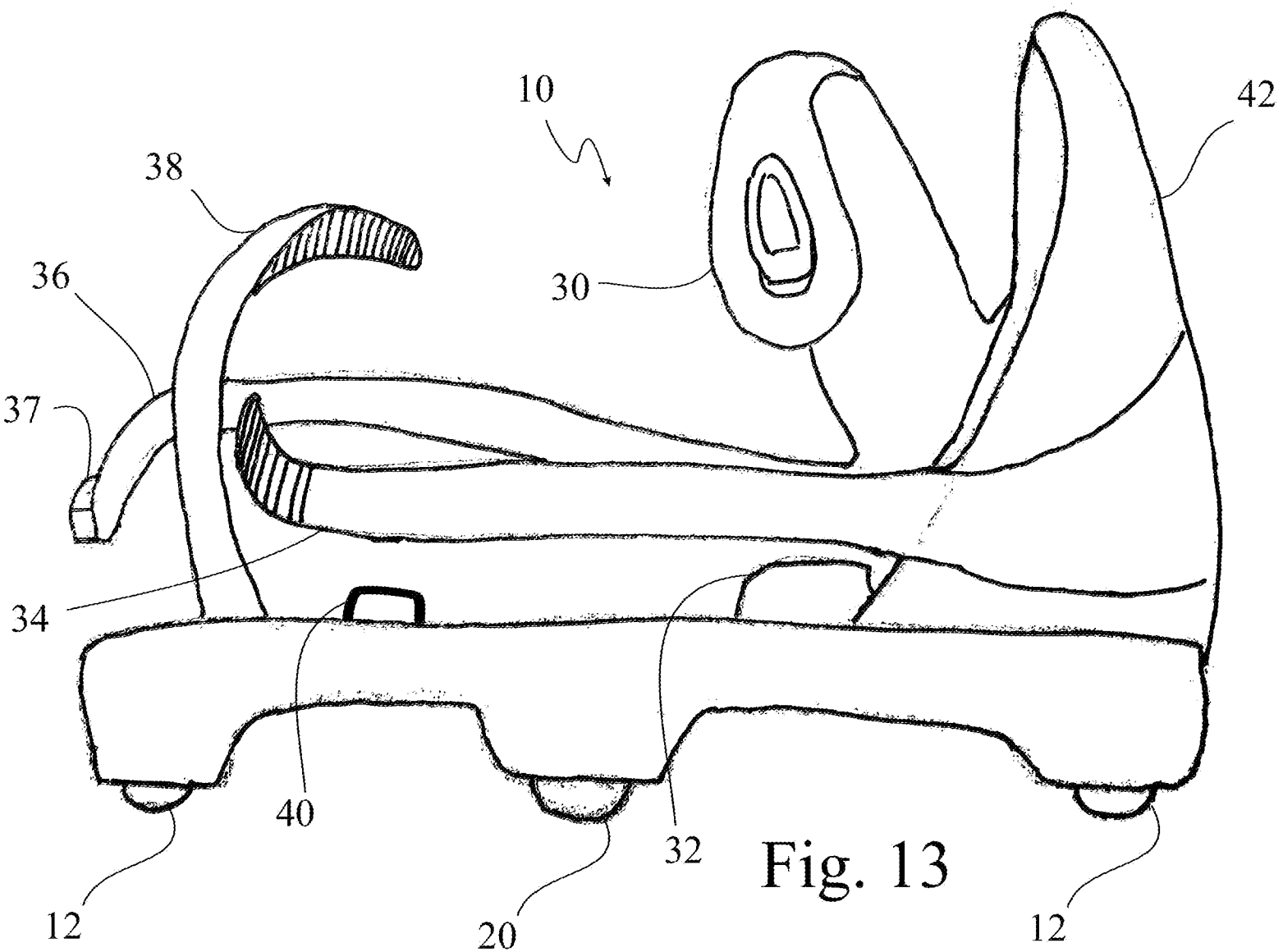
FIG. 13 is a side view of a base attachable to a piece of sports footwear, according to an embodiment.

In a preferred embodiment, illustrated in FIG. 1 and FIG. 13, a base 10 may be provided as a sole attachable to a piece of sports footwear, such as a ski boot or snowboarding boot. The bases in both FIGS. 1 and 13 may have the same configuration and placement of ball bearing assemblies as described in FIG. 12.

The base 10 may be provided as a sole with attachment mechanisms such as straps, hook and loop fasteners such as Velcro™, laces, and buckles, among others. In the embodiment illustrated in FIG. 13, the base 10 is attachable by a set of straps. A midfoot strap 30 wraps around the midfoot of a boot and inserts into buckle 32. The midfoot strap 30 and buckle 32 secure the boot (not shown) at the midfoot and hindfoot area. A pair of longitudinal straps 34 and 36 wrap from the heel around the front of the foot. A buckle at the end of strap 36 receives the end of strap 34, which may be inserted into buckle 37 up to a depth necessary to obtain sufficient tightness to secure the boot in the longitudinal direction. A forefoot strap 38 inserts into buckle 40 to secure the forefoot of the boot. A heel portion 42 secures the backend of the footwear and, in combination with longitudinal straps 34 and 36, prevents relative longitudinal motion of the boot 11 (not shown) and base 10.

When a base 10 is attachable to a piece of sports footwear 11, as illustrated in FIG. 13, it may be designed to be attachable to footwear of any of a variety of sizes or configurations. In such embodiments, the user may use the base 10 in combination with their own conventional sports footwear, such as their own pair of ski boots. In embodiments where the base 10 is structured as a board with attachment mechanisms, it may be attachable to a corresponding set of board footwear, such as the user's own snowboarding boots. The base in FIG. 13 may be designed to be adjustable in length and width to fit different sizes of sports footwear. The tightness of the attachment mechanisms may be varied to accommodate different sizes of sports footwear and different desired tightness of the base on the sports footwear. A slidable or extendable platform that may sit on top of the base to allow for expansion and contraction of the platform to accommodate different sizes of sports footwear. Different ranges of sizes of sports footwear may be accommodated by one size of base. Different sizes of bases may be constructed to fit various different potential ranges of sizes of sports footwear.

The base 10 may be used in combination with a treadmill 102 (FIG. 5) and treadmill control (not shown). The treadmill control may be mountable and electrically connectable to the treadmill 102 to control at least one of speed, elevation, and surface variations of the treadmill. FIG. 5 illustrates a user 100 standing on a treadmill 102 wearing footwear 11 with integrated bases 10. Controlling elevation of the treadmill 102 may include one or more of raising the whole surface and adjusting the height of one or more corners or edges relative to corners or edges of the treadmill. Controlling surface variations of the treadmill may comprise producing bumps, ridges, trenches and divots, among other shapes and types of variations. Surface variations in the treadmill 102 may be produced by one or more actuators in the treadmill structure.

The treadmill 102 may be coordinated with a simulation of the selected sport, in which a user 100 traverses simulated terrain. The simulation may be displayed to the user on a graphical display or a screen (not shown). Such a screen may be attached to or separate from the treadmill. In one embodiment, the graphical display may be projected onto a surface by a projector. When the user 100, within the simulation, approaches and moves onto features of the simulated terrain, the treadmill be controlled to produce changes in the speed, elevation, and surface variations of the treadmill. For example, in a skiing simulation as the skier goes over a rugged and steep slope, the treadmill may be adjusted to increase the speed, raise the back end of the treadmill while lowering the front end of the treadmill 102 to tilt the user forward, and create a bumpy surface in the treadmill belt.

There may be one or more sensors either on the treadmill 102 or elsewhere in the space which may sense the location of one or more of the user 100, the base 10, a board 104, and sports footwear 11. Surface features on sports footwear 11 may be used to improve the sensitivity of the sensors to the location and orientation of the sports footwear. For example, a pattern of dots or a set of divots may be provided on the sports footwear and may be observed by the sensors and then used by a processor to identify the position and orientation of the footwear 11 on the treadmill 102. Sensors may also be used to identify other objects, including the user or parts of the user 100. In one such embodiment, the input of the sensors may be used by a processor to recognize the locations and orientations of the limbs, trunk and/or head of the user 100.

The processor may use location and orientation data to adjust the user's simulation. For example, in a skiing simulation if the user rotates turns their feet each counter clockwise from straight and leans left in a manner that would produce a left turn when skiing on a slope, the processor may use that information to adjust the simulation so that the user observes a left turn in the graphical simulation.

A method of using a rolling base on a treadmill is provided, comprising a user standing on a rolling base on an operating treadmill and providing a graphical simulation of a sports activity through a display, wherein the rolling base comprises three or more first ball bearing assemblies, each of the three or more first ball bearing assembly comprising a ball, and a mounting assembly; and the rolling base further comprises one or more lower ball bearing assemblies, each of the one or more lower ball bearing assemblies comprising a ball and a mounting assembly, each one of the one or more lower ball bearing assemblies projecting down from a plane defined by three or more of the ball bearing assemblies.

The method may comprise controlling operation of the treadmill according to the events occurring in the simulation of a sports activity, wherein controlling operation of the treadmill comprises one or more of controlling the speed, altitude, tilt and surface features of the treadmill. In a step, a system may detect a part of a user and process the location of the part of the user as a control input for the simulation of a sports activity.

In embodiments of a method, detecting a part of a user may comprise detecting the location or orientation of a piece of sports footwear worn by the user. Detecting a part of a user might also or alternative comprise detecting the location or orientation of one or more of the user's limbs, trunk, and head.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A base for use on a treadmill, the base comprising:

three or more first ball bearing assemblies, each of the three or more first ball bearing assemblies comprising a ball and a mounting assembly; and one or more lower ball bearing assemblies, each of the one or more lower ball bearing assemblies comprising a ball and a mounting assembly;

wherein each of the one or more lower ball bearing assemblies extends downwards from a plane defined by a subset of three of the first ball bearing assemblies, the lower ball bearing assemblies projecting further downward from the plane than the first ball bearing assemblies and of a vertical projection of the one or more lower ball bearing assemblies onto the plane intersects a triangle with vertices located at the first ball bearing assemblies of the subset of three, thereby allowing the base to pivot in multiple directions around the one or more lower ball bearing assemblies when placed on a flat surface.

2. The base of claim 1 being a sole, and the sole being integrally formed with a piece of sports footwear.

3. The base of claim 1 being removeably attachable to a piece of sports footwear.

4. The base of claim 3 in which the base is a lower surface of a board.

5. The base of claim 4 in which the board is a snowboard.

6. The base of claim 5 used in combination with a snowboarding boot.

7. The base according to claim 1 in which the three or more first ball bearing assemblies are arranged as two rows of first ball bearing assemblies and the at least one or more lower ball bearing assemblies lie between the two rows of first ball bearing assemblies.

8. The base according to claim 1 in which the three or more first ball bearing assemblies are arranged as at least three consecutive rows of first ball bearing assemblies on the base and the one or more lower ball bearing assemblies are positioned between each consecutive pair of rows of first ball bearing assemblies.

9. The base according to claim 1 used in combination with a treadmill control, the treadmill control being mountable and electrically connectable to the treadmill to control at least one of speed, elevation, and surface variations of the treadmill.

10. The base according to claim 1 wherein each of the one or more lower ball bearing assemblies is larger than the three or more first ball bearing assemblies.

11. The base according to claim 1 wherein each of the one or more lower ball bearing assemblies is situated downwardly relative to the subset of three of the three or more of the first ball bearing assemblies.

12. The base according to claim 1 wherein each mounting assembly of the three or more first ball bearing assemblies and of the one or more lower ball bearing assemblies comprises a mounting socket and a spring.

13. A method of using a rolling base on a treadmill, comprising:

a user standing on the rolling base on an operating treadmill; and providing a graphical simulation of a sports activity through a display;

wherein the rolling base comprises:

three or more first ball bearing assemblies, each of the three or more first ball bearing assembly comprising: a ball, and a mounting assembly; and one or more lower ball bearing assemblies, each of the one or more lower ball bearing assemblies comprising a ball and a mounting assembly;

wherein each of the one or more lower ball bearing assemblies extends downwards from a plane defined by a subset of three of the first ball bearing assemblies, the lower ball bearing assemblies projecting further downward from the plane than the first ball bearing assemblies; and a vertical projection of the one or more lower ball bearing assemblies onto the plane intersects a triangle with vertices located at the first ball bearing assemblies of the subset of three, thereby allowing the base to pivot in multiple directions around the one or more lower ball bearing assemblies when placed on a flat surface.

14. The method of claim 13 comprising controlling operation of the treadmill according to events occurring in the simulation of a sports activity.

15. The method of claim 14 wherein controlling operation of the treadmill comprises one or more of controlling speed, altitude, tilt and surface features of the treadmill.

16. The method of claim 13 comprising detecting a part of the user and processing a location of the part of the user as a control input for the graphical simulation.

17. The method of claim 16 wherein detecting a part of the user comprises detecting a location or orientation of a piece of sports footwear worn by the user.

18. The method of claim 16 wherein detecting a part of the user comprises detecting a location or orientation of one or more of the user's limbs, trunk, and head.

19. A base or sole for a piece of footwear for use on a treadmill, the base or sole comprising:

four ball bearing assemblies arranged in a rectangular distribution on the base or sole, each of the four ball bearing assemblies comprising a ball and a mounting assembly; and one or more lower ball bearing assemblies arranged within the rectangular distribution, wherein each of the one or more lower ball bearing assemblies extends downwards from a plane defined by a subset of three of the four ball bearing assemblies, the lower ball bearing assemblies projecting further downward from the plane than the four ball assemblies; and a vertical projection of the one or more lower ball bearing assemblies onto the plane intersects a triangle with vertices located at the subset, thereby allowing the base to pivot in multiple directions around the one or more lower ball bearing assemblies when placed on a flat surface.

* * * * *